US011839789B2

(12) United States Patent
Chrobok

(10) Patent No.: US 11,839,789 B2
(45) Date of Patent: Dec. 12, 2023

(54) WEARABLE TRAINING APPARATUS

(71) Applicant: Thomas Chrobok, Detmold (DE)

(72) Inventor: Thomas Chrobok, Detmold (DE)

( * ) Notice: Subject to any disclaimer, the term of this patent is extended or adjusted under 35 U.S.C. 154(b) by 127 days.

(21) Appl. No.: 17/421,656

(22) PCT Filed: Jul. 30, 2020

(86) PCT No.: PCT/EP2020/071467

§ 371 (c)(1),
(2) Date: Jul. 8, 2021

(87) PCT Pub. No.: WO2021/073790

PCT Pub. Date: Apr. 22, 2021

(65) Prior Publication Data

US 2022/0072360 A1 Mar. 10, 2022

(30) Foreign Application Priority Data

Oct. 17, 2019 (EP) ..... 19203937

(51) Int. Cl.
*A63B 21/065* (2006.01)
*A63B 21/00* (2006.01)
(Continued)

(52) U.S. Cl.
CPC ..... *A63B 21/065* (2013.01); *A63B 21/023* (2013.01); *A63B 21/0421* (2013.01);
(Continued)

(58) Field of Classification Search
CPC ..... A63B 21/0004; A63B 21/00185; A63B 21/02; A63B 21/025; A63B 21/026;
(Continued)

(56) References Cited

U.S. PATENT DOCUMENTS 5,743,837 A * 4/1998 Dias ..... A63B 21/4001 482/121
6,080,090 A * 6/2000 Taylor ..... A63B 23/03516 482/121
(Continued)

FOREIGN PATENT DOCUMENTS

DE 2536560 A1 2/1977
DE 10217368 C1 10/2003
(Continued)

OTHER PUBLICATIONS

An Office Action mailed by the Japanese Patent Office dated Nov. 11, 2022, which corresponds to Japanese Patent Application No. 2021-544824 and is related to U.S. Appl. No. 17/421,656.
(Continued)

*Primary Examiner* — Loan B Jimenez
*Assistant Examiner* — Zachary T Moore
(74) *Attorney, Agent, or Firm* — Studebaker & Brackett PC

(57) ABSTRACT

The invention relates to a wearable training apparatus for training the leg and torso muscles of a person. According to the invention provision is made in that for placement on the back of the person a back support with two lateral sections is provided which extend into the region of the hip, in that two leg brackets are provided which are each designed for attachment to a thigh on one of the legs of the training person, and in that the leg brackets are each connected to one of the lateral sections of the back support via a spring joint means which is arranged in the region of the hip and designed to generate a spring force between torso and thighs, through which torso and thighs are pressed forwards relative to each other.

10 Claims, 2 Drawing Sheets

Figure 1:
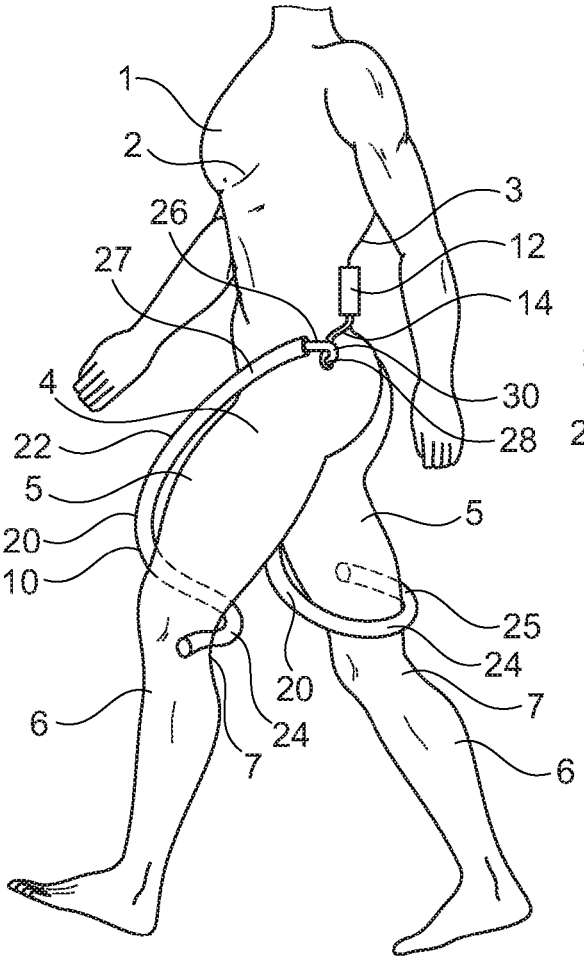

(51) Int. Cl.
*A63B 21/02* (2006.01)
*A63B 21/04* (2006.01)

(52) U.S. Cl.
CPC ..... *A63B 21/4009* (2015.10); *A63B 21/4011* (2015.10); *A63B 2209/00* (2013.01)

(58) Field of Classification Search
CPC . A63B 21/04; A63B 21/0421; A63B 21/0435; A63B 21/065; A63B 21/4001; A63B 21/4009; A63B 21/4011; A63B 69/0057; A63B 69/0059; A63B 69/0062
See application file for complete search history.

(56) References Cited

U.S. PATENT DOCUMENTS

| | | | | |
|---|---|---|---|---|
| 6,171,221 | B1 * | 1/2001 | Hayduk | A63B 21/065 482/106 |
| 7,481,742 | B2 * | 1/2009 | Katoh | A61H 1/0255 602/23 |
| 8,900,105 | B2 * | 12/2014 | Zhu | A63B 21/4047 482/127 |
| 10,327,975 | B2 * | 6/2019 | Zoss | B25J 9/0006 |
| 2007/0027008 | A1 * | 2/2007 | Levinson | A63B 21/4047 482/121 |
| 2012/0316041 | A1 * | 12/2012 | Meister | A63B 23/0233 482/140 |
| 2015/0360071 | A1 * | 12/2015 | Lee | A63B 23/1281 482/121 |
| 2017/0014296 | A1 | 1/2017 | Nagarajan et al. | |
| 2017/0274243 | A1 | 9/2017 | Lorca | |
| 2017/0274249 | A1 | 9/2017 | Moebius et al. | |

FOREIGN PATENT DOCUMENTS

| | | | |
|---|---|---|---|
| DE | 202004001302 | U1 | 4/2004 |
| DE | 202009000076 | U1 | 4/2010 |
| DE | 102016114349 | A1 | 8/2017 |
| EP | 3257557 | A1 | 12/2017 |
| JP | 3045412 | U | 2/1998 |
| JP | 2016-502906 | A | 2/2016 |
| SU | 820855 | A1 | 4/1981 |

OTHER PUBLICATIONS

International Search Report issued in PCT/EP2020/071467; dated Oct. 29, 2020.
International Preliminary Report on Patentability and Written Opinion issued in PCT/EP2020/071467; dated Apr. 19, 2022.
An Office Action mailed by the Japanese Patent Office dated May 19, 2023, which corresponds to Japanese Patent Application No. 2021-544824 and is related to U.S. Appl. No. 17/421,656.

* cited by examiner

WEARABLE TRAINING APPARATUS

The invention relates to a wearable training apparatus for training the leg and torso muscles of a person according to the preamble of the claim 1.

In the fitness sector a variety of training apparatuses are known, with which a leg and torso musculature, in particular the buttock musculature, more particularly the musculus gluteus maximus, can be trained.

A generic training apparatus with two leg brackets, spring joint means, lateral sections and a back support can be taken from U.S. Pat. No. 5,743,837. This apparatus is produced of a plurality of parts and tension straps.

A stationary training apparatus for the buttock musculature and the spinal erector can be taken from DE 20 2004 001 302 U1 for example. Stationary training apparatuses require a corresponding amount of space and surface and are mainly utilized in so-called fitness centers. A flexible usage e.g. in the home area is hardly possible with such apparatuses.

From DE 10 2016 114 349 A1 a wearable training apparatus for the human body is known. This has a strap system with tension straps and loops. However, such a strap system is complicated in its placement and, in addition, only limited forces can be generated. Through incorrect placement the risk of incorrect strain and even physical damage can arise.

Further wearable training apparatuses for training the back musculature can be taken from DE 102 17 368 01, US 2017/0274243 A1, SU 820 855 A1 or DE 25 36 560 A1 which are also fixed on the human body by means of straps. With these apparatuses there is also the problem of laborious strap setting and securing that entails the risk of incorrect strain.

US 2015/0360071 A1 discloses a training apparatus constructed of three parallel rigid bars that are connected to each other via lateral levers. The center bar has a spring tensioning means.

US 2017/0014296 A1 and DE 20 2009 000 076 U1 disclose framework-like exoskeletons which serve to support and facilitate a movement of the body. The exoskeletons are fixed on the arms and legs via tension straps.

The invention is based on the object to provide a wearable training apparatus which is of compact construction and easy to use.

In accordance with the invention the object is achieved by a wearable training apparatus having the features of claim 1. Preferred embodiments of the invention are stated in the dependent claims.

In the training apparatus according to the invention provision is made in that for placement on the back of the person a back support with two lateral sections is provided which extend into the region of the hip, in that two leg brackets are provided which are each designed for attachment to a thigh on one of the legs and in that the leg brackets are each connected to one of the lateral sections of the back support via a spring joint means which is arranged in the region of the hip and designed to generate a spring force between torso and thighs, through which torso and thighs are pressed forwards relative to each other.

A fundamental idea of the invention resides in the fact that a compact training apparatus is provided which can be worn by persons even during everyday activities and has a simple structure with a bracket construction. The training apparatus according to the invention substantially comprises a back support and two leg brackets that are connected to the back support via two lateral spring joint means. The spring joint means are arranged in the region of the hip joint and generate a tensioning force between torso and thighs.

When a person stands upright this tensioning force causes a compressive force onto the back of the training person and a compressive force onto both thighs of the person. The tensioning or spring force is generated such that the torso or upper body of the person is pressed forwards. To counteract this force the person has to apply a counterforce in the upright position, through which the torso musculature, in particular the back muscles, the thigh muscles and buttock muscles, in particular the musculus gluteus maximus, are trained.

Through the training apparatus according to the invention a permanent static force can in particular be exerted onto the human body so that training is particularly gentle on the joints and the training apparatus can be worn by the person without any problem during everyday activities, in particular when standing or walking. In addition to a specific training effect for the buttock musculature the posture of the upper body is also improved by training the entire torso musculature.

According to a further development of the invention it is especially advantageous for the leg brackets, the lateral sections and/or the back support to be shaped of a wire or tube. In particular, it is possible to form the entire training apparatus largely in one piece from a bar material that extends from one thigh across the back to the other thigh. Basically, the training apparatus can also be composed in a multi-piece manner from several components. The wire or tube can have a round or angular cross-section and be manufactured from a metal such as steel, in particular a light metal, preferably an aluminum alloy. Basically, the training apparatus can also be produced with components consisting of other materials, for example plastic, glass-fiber reinforced plastic, acrylic glass or a carbon material.

Due to the bracket-like structure of the training apparatus it can be easily placed on a person. Since a spring force is applied by the spring joint means the training apparatus, when in the placed-on state, can be arranged by being braced between the thighs and the back so that this can be worn even without additional fixing measures by means of retaining straps.

According to a further development of the invention a particularly compact construction is accomplished in that at least a part of the leg brackets and the respective adjoining lateral section of the back support, together with the spring joint means, are bent from an elastic tension wire and in that the spring joint means has at least one wire loop. The spring joint means can also be formed by several wire loops that are formed of the tension wire. In particular, a simple bracket-like construction can thus be achieved that can be worn over or even under clothing.

According to a further development of the invention particularly good adaptability is achieved in that the spring joint means is adjustable. For this, the spring joint means can be designed with a box-like housing, in which e.g. by means of an adjustment lever an initial state of a helical tension spring in particular can be changed in that through rotation in one direction the tensioning force is increased and in an opposite direction the tensioning force is reduced. The spring joint means can have adjustable tension elements consisting of rubber or pneumatically or hydraulically acting tension elements. These can be arranged at least partially in the tube cavity of the adjoining tubular leg brackets or lateral sections. Through this, the spring joint means can be adapted to the respective training condition of the person.

According to a further development of the invention it is advantageous if the spring joint means is releasably connected to one of the two brackets and one of the lateral sections of the back support. This simplifies producibility and enables the production of different variants with different tensioning or spring forces.

According to an embodiment variant of the invention good wearing comfort can be achieved in that the training apparatus is at least partially provided with a padding. Here, the padding can be a rubber or foam coating provided at least on regions of the leg brackets, the lateral sections and/or the back support. The back support itself can be formed of shaped plastic. The leg brackets, the lateral sections and the back support can substantially be dimensionally stable, in which case the spring joint means permits a joint-like adjustment between leg bracket and back support whilst generating a tensioning force.

Further improvement of the wearing comfort can be attained in that an adjustment means is arranged on the leg brackets, the lateral sections and/or on the back support. The adjustment means allow dimensional changes to a predetermined extent in order to adapt the individual components to the body of the respective person to do training.

In conjunction with this it is especially expedient that the adjustment means has telescopic elements which are adjustable in their length. Such telescopic elements can in particular be attached to longitudinal sections of the leg brackets or to the lateral sections of the back support. Here, the telescopic elements allow telescopic shifting in relation to each other, in which case at least one setting screw or a bayonet catch is provided for locking in a desired telescopic position.

Another preferred embodiment of the invention resides in that the leg brackets each have a longitudinal section which extends along the thigh and a retaining section, with which the leg brackets are retained on the thighs. The retaining section can basically have one or several straps to fix the leg bracket on the thigh.

According to a further development of the invention it is particularly expedient that the retaining section has a retaining loop which engages at least partially around the thigh. Thereby, the retaining loop can be arranged at the free end of the leg bracket and designed such that it engages at least partially around the thigh and runs on a rear side of the thigh. Here, the retaining loop is shaped, more particularly bent in a loop-like manner of the wire or tube of the leg bracket. As a result, altogether high tensioning forces can be applied between the leg muscles and the back muscles which leads, in particular, to an excellent training effect for the buttock muscles.

Figure 2:
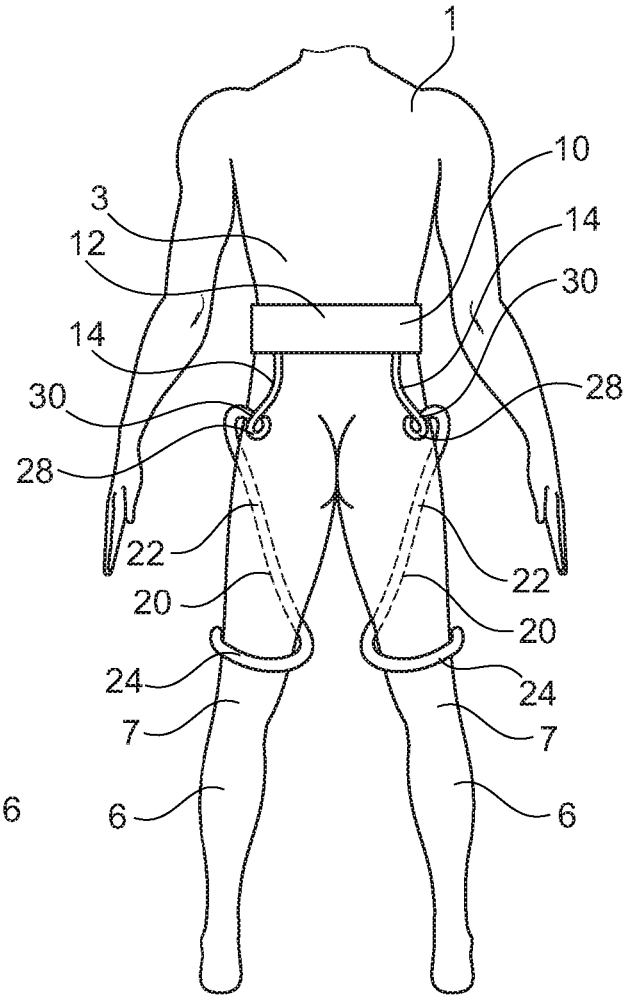
Figure 3:
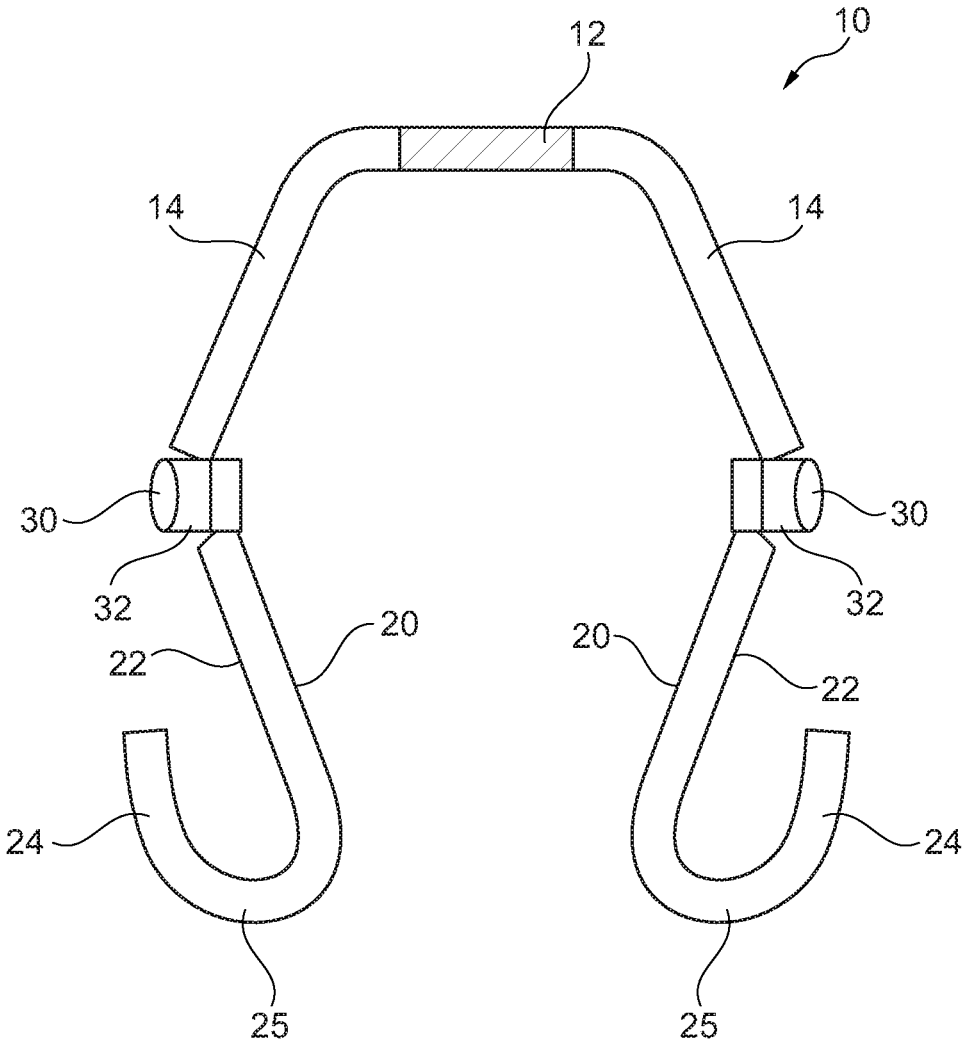

The invention is described further hereinafter by way of preferred embodiments illustrated schematically in the drawings, wherein show:

FIG. 1 a side view of a person with the training apparatus according to the invention;

FIG. 2 a view of the back of the person with the training apparatus of FIG. 1; and FIG. 3 a further embodiment of a training apparatus according to the invention.

According to FIGS. 1 and 2 a wearable training apparatus 10 is illustrated which is placed on and worn by a person 1 to do training. The training apparatus 10 has a plane back support 12 which comes to rest on a back 3 on the torso 2 of the person 1. Laterally of the back support 12 two lateral sections 14 extend into the region of the hip 4 of the person 1.

Furthermore, the wearable training apparatus 10 has two leg brackets 20, wherein each leg bracket 20 is arranged on a thigh 5 of a leg 6 of the person 1. Here, the two leg brackets 20 are each connected via a spring joint means 30 to the lateral sections 14. In the illustrated embodiment according to FIGS. 1 and 2 the wearable training apparatus 10 has a simple construction of wire 26, wherein the spring joint means 30 is formed by a simple wire loop 28. At least on the leg brackets 20 the wire 26 can be provided with a padding 27, for example consisting of a rubber or foam material, more particularly a tubular foam.

The leg brackets 20 each have a longitudinal section 22 which substantially runs in a straight manner and extends on a front side of the respective thigh 5 from the spring joint means 30 to a lower region of the thigh 5. In their lower region the leg brackets 20 have a retaining section 24 that adjoins the longitudinal section 22 and comprises, in particular, an arched retaining loop 25. The arched retaining loop 25 engages around or embraces the thigh 5 from the front side of the respective thigh 5 along the inner side of the thigh so that the retaining section 24 ends in each case on the rear side of the thigh 5 slightly above the hollow of the knee 7 of the person.

In an unworn resting state of the training apparatus 10 the back support 12 is bent forwards towards the leg brackets 20, with a specific pretension angle being preset between the leg brackets 20 and the back support 12. For placement of the training apparatus 10 this pretension angle is bent open, whereby the back support 12 places itself with a certain spring or pressing force on the back 3. At the same time the leg brackets 20 are placed around the respective thigh 5 so that due to the respective pressing force the back support 12 and the leg brackets 20 are each retained in a force-fitting manner on the person 1 without additional retaining means.

To assume an upright position illustrated in FIGS. 1 and 2 the person 1 has to apply a counter-force to the tensioning force applied by the spring joint means 30 so that due to this force application the musculature of the person 1 in the region of the torso 2, the thighs 5 and in particular in the region of the buttocks are trained and strengthened.

Due to the simple construction of the training apparatus 10 according to the invention this can be readily worn by the person 1 even during everyday activities over or under outer clothing.

In addition to the simple wire-like construction according to FIGS. 1 and 2 a further embodiment of the invention is illustrated in FIG. 3. In the case of the wearable training apparatus 10 according to FIG. 3 the back support 12 and the adjoining lateral sections 14 are formed of a tube. Likewise, the leg brackets 20 are also shaped of a corresponding tube.

The back support 12 with the lateral sections 14 and the leg brackets 20 are connected to each other via a spring joint means 30, in which case this is releasably fixed, in particular screwed on the lateral sections 14 and the leg brackets 20.

In the illustrated embodiment according to FIG. 3 the spring joint means 30 has a box-like housing 32, in which an actual tension spring means is arranged. Through an adjustment means not illustrated in greater detail, e.g. an adjustment lever or a rotatable tensioned cover, the spring force and/or a pretension angle can be set between the back support 12 with the lateral sections 14 and the leg brackets 20. In this way, the force to be applied by the person can be adapted to the respective training condition of the person.

In the depicted embodiment the leg brackets 20 are designed similar to an umbrella handle with a longitudinal section 22 and a retaining section 24 in each case, wherein the retaining sections 24 are shaped as approximately semicircular, arched retaining loops 25. The back support 12 with the lateral sections 14 and the leg brackets 20 can also be provided with a padding for enhanced wearing comfort.

The invention claimed is:

1. A wearable training apparatus for training of muscles in legs and torso of a person comprising:

a back support with two lateral sections for placement on a back of the person, the lateral sections extending into a region of a hip, two leg brackets each configured for attachment to a thigh on one of the legs, and the leg brackets respectively connected to one of the lateral sections of the back support, wherein connection of the leg brackets to the back support is formed via spring joints, the spring joints are arranged in the region of the hip and configured to generate a spring force between the torso and thighs while the person is standing or walking, through which the torso and thighs are pressed forwards relative to each other, and in a placed-on state the wearable training apparatus is braced between the thighs and the back so that the wearable training apparatus can be worn without retaining straps.

2. The wearable training apparatus according to claim 1, wherein the leg brackets, the lateral sections and/or the back support are in a shape of a wire or tube.

3. The wearable training apparatus according to claim 1, wherein at least a part of the leg brackets and a respective adjoining lateral section of the back support, together with the spring joints, are bent from an elastic tension wire, and the spring joints have at least one wire loop.

4. The wearable training apparatus according to claim 1, wherein the spring joints have an adjustable tension spring.

5. The wearable training apparatus according to claim 1, the spring joints are releasably connected to one of the leg brackets and one of the lateral sections of the back support.

6. The wearable training apparatus according to claim 1, wherein the wearable training apparatus is at least partially provided with a padding.

7. The wearable training apparatus according to claim 1, wherein at least one of the leg brackets, the lateral sections, or the back support is adjustable.

8. The wearable training apparatus according to claim 7, wherein the at least one of the leg brackets, the lateral sections, or the back support are adjustable in their length by way of telescopic elements.

9. The wearable training apparatus according to claim 1, wherein the leg brackets each have a longitudinal section which extends along the thigh and a retaining section, with which the leg bracket is retained on the thigh.

10. The wearable training apparatus according to claim 9, wherein the retaining section has a retaining loop which engages at least partially around the thigh.

* * * * *